United States Patent [19]

Sakai

[11] 4,057,041

[45] Nov. 8, 1977

[54] ICING PREVENTING DEVICE FOR A CARBURETOR FOR TWO-CYCLE ENGINE USE

[75] Inventor: Makoto Sakai, Kawasaki, Japan

[73] Assignee: Kabushiki Kaisha Keihinseiki Seisakusho, Kawasaki, Japan

[21] Appl. No.: 625,512

[22] Filed: Oct. 24, 1975

[30] Foreign Application Priority Data

Oct. 28, 1974 Japan ..... 49-129482[U]

[51] Int. Cl.[2] ..... F02B 33/04

[52] U.S. Cl. ..... 123/73 AD; 261/18 R; 261/DIG. 20

[58] Field of Search ..... 123/73 AD, 19.6 R; 184/6.9, 6 R, 7 R; 261/44 R, 18 R, DIG. 20

[56] References Cited

U.S. PATENT DOCUMENTS

| | | | |
|---|---|---|---|
| 2,273,202 | 2/1942 | Jackson | 123/73 AD |
| 3,447,519 | 6/1969 | Marcik et al. | 123/73 AD |
| 3,908,612 | 9/1975 | Lamm | 123/73 AD |
| 3,929,110 | 12/1975 | Raikov et al. | 123/73 AD |

FOREIGN PATENT DOCUMENTS

| | | | |
|---|---|---|---|
| 1,190,252 | 4/1965 | Germany | 123/73 AD |

*Primary Examiner*—Ronald H. Lazarus
*Assistant Examiner*—David D. Reynolds
*Attorney, Agent, or Firm*—Haseltine, Lake & Waters

[57] ABSTRACT

Icing troubles with carburetors of two-cycle engines can be effectively avoided by the provision of an engine-lubricating-oil nozzle arranged in the carburetor and opening into the intake air passage therein in a position adjacent to the fuel nozzle in opposing relation to the throttling end of the piston type air throttle valve so that oil films are formed on the exposed surfaces of the throttle valve and the needle valve associated therewith to control the rate of fuel discharge into the intake air passage. Any ice possibly formed on the valve surfaces readily exfoliate, not causing any sticking of the throttle and needle valves in the carburetor.

2 Claims, 1 Drawing Figure

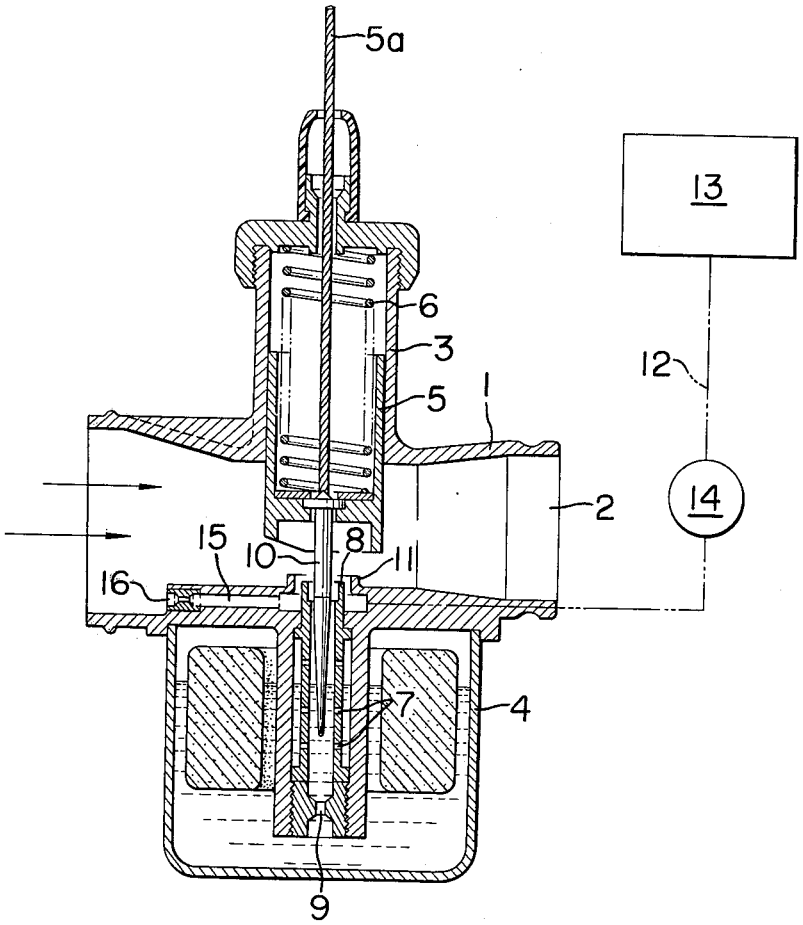
5a
13
6
3
12
5
1
2
14
15
10
8
11
16
7
4
9

ICING PREVENTING DEVICE FOR A CARBURETOR FOR TWO-CYCLE ENGINE USE

FIELD OF THE INVENTION

This invention relates generally to carburetors for two-cycle internal-combustion engines of the type having a source of fuel supply and an engine lubricating oil supply arranged independently from each other and having a sliding type of throttle valve.

BACKGROUND

Heretofore, carburetors of the type described have generally been regarded as unsuitable for use in cold climates as they often show a tendency, when used in such climates, of the throttle valve to stick or become unable to slide, causing trouble in the control of the engine power output, since the air drawn into the carburetor is inevitably deprived of its heat by fuel evaporation therein to cause the moisture contained in the air to freeze to form ice on the throttle valve and thereabout.

SUMMARY OF THE INVENTION

An object of the present invention is the provision of an icing preventing device for a carburetor of the type described, which makes the carburetor usable even in cold climates without any icing trouble.

According to the present invention, carburetor icing is effectively prevented by discharging engine lubricating oil through an annular orifice formed around the fuel nozzle thereby to form oil films on the sliding surfaces of the throttle valve and the needle valve arranged at the bottom thereof.

The above and other objects, features and advantages of the invention will become apparent from the following description when taken in conjunction with the accompanying drawing.

BRIEF DESCRIPTION OF THE DRAWING

The sole FIGURE of the drawing represents a vertical cross-sectional side elevation view, partly schematic, of a carburetor equipped with a preferred form of icing preventing device of the present invention.

DESCRIPTION OF THE PREFERRED EMBODIMENT

Referring to the drawing, the carburetor illustrated includes a casing 1 which defines therein a horizontally extending intake air passage 2 and the casing is formed with an integral throttle-valve guide barrel 3 on the top side of the passage 2. The casing 1 also carries a float chamber 4 on the underside of the passage 2. A piston-type throttle valve 5 is slidably fitted in the guide barrel 3 with a throttle-valve restoring spring 6 arranged therein to normally bias the throttle valve 5 downwardly to its closed position. For operation of the throttle valve 5, an operating wire or cable is connected thereto, as indicated at 5*a*. It is to be understood that, in this illustration, the intake air passage 2 is connected at the right-hand end to the intake duct of the associated two-cycle engine.

Fitted in the carburetor casing 1 at the bottom of the intake air passage 2 is a fuel nozzle 8 of tubular structure which includes a generally cylindrical wall formed with a multitude of air bleed apertures 7. The tubular fuel nozzle 8 opens at the top into the intake air passage 2 in a position opposite to the adjacent end of the throttle valve 5 and is placed at the bottom in fluid communication with the float chamber 4 through the intermediary of a fuel orifice 9 under the fuel level in the chamber. A needle valve 10 having a tapered tip is supported at its top end on the bottom face of the throttle valve 5, that is, the throttling end thereof, and extends downwardly into the fuel nozzle 8. The float chamber 4 is in fluid communication with a fuel tank (not shown) by way of a float valve in a well-known manner.

Though the structure described above is generally conventional with carburetors of the kind described, the carburetor illustrated further comprises, according to the present invention, an oil nozzle 11 which is formed in the intake air passage 2 on the bottom wall thereof opposite to the end face of the throttle valve 5 and nozzle 11 opens into the intake air passage 2 through an annular opening defined around the top end portion of fuel nozzle 8. The oil nozzle 11 is connected to a lubricating oil reservoir tank 13 by way of an oil supply line 12. Arranged on the oil supply line 12 is an oil metering pump 14 which is operatively connected with the two-cycle engine to deliver a metered amount of oil from the reservoir tank 13. The oil nozzle 11 is also in fluid communication with the intake air passage 2 on the upstream side of the top opening of oil nozzle 11 by means of an air bleed hole 15 which opens at one end into the intake air passage 2 and at the other end into the oil nozzle 11 and which is formed intermediate the ends thereof with an air orifice 16, as illustrated, at a location adjacent to said one end.

With the construction and arrangement described above, when an air flow is produced in the intake air passage 2 under engine suction, air pressure therein is materially reduced particularly the underside of the throttle valve 5. As a result, fuel is discharged from the float chamber 4 through the fuel nozzle 8 as a jet of particles finely divided under the effect of air ejecting into the fuel nozzle through air bleed apertures 7 while at the same time oil delivered by the metering pump 14 is discharged into the air passage 2 through the oil nozzle 11 as a jet of particles finely divided under the effect of air ejecting into the oil nozzle through the air bleed hole 15. The fuel and lubricating oil jets are fully mixed in the intake air passage 2 with the air flowing therethrough and the mixture formed is drawn into the engine for power production and engine lubrication. It is to be noted that the amount of air bleed into the oil nozzle 11 is properly metered by the air orifice 16 provided in the air bleed hole 15. The flow rate of fluid mixture through the intake air passage 2 and the amount of fuel discharged therein are respectively controlled by the opening of the throttle valve 5 and the needle valve 10 in conventional manner.

As will readily be understood, lubricating oil discharged into the intake air passage 2 through the oil nozzle 11 comes into contact with the downstream side half of the peripheral surface of the throttle valve 5 exposed to the intake air and with the whole periphery of the needle valve 10 exposed thereto and thus forms oil films on the exposed valve surfaces. Due to this, if any ice is formed on such surfaces, as the intake air, more or less moisture-laden, is cooled with evaporation of fuel ejected therein, such ice will readily exfoliate and the danger that the throttle valve 5 or needle valve 10 will become frozen and to stick and held against axial sliding movement is effectively eliminated even if atmospheric moisture is high.

To summarize, according to the present invention, in a carburetor designed to discharge fuel and lubricating oil separately into the intake air flow, the oil nozzle is arranged in a position adjacent to the fuel nozzle and opposite to the throttling end of the throttle valve to serve the purpose of forming oil films on the peripheral surfaces of the throttle and needle valves exposed in the intake air passage so that the sliding regions of such valves are effectively protected from any such ice formation thereon as may cause them to stick. In this manner, the carburetor embodying such icing preventing device is safely usable even in cold climates without any trouble otherwise occurring in engine output control.

Though one preferred embodiment of the present invention has been shown and described, it is to be understood that many changes and modifications may be made therein without departing from the spirit of the invention of the scope of the appended claims.

What is claimed is:

1. In a carburetor for a two-cycle internal-combustion engine having a casing with an intake air passage, a throttle valve slidably mounted in said casing, a fuel nozzle having an outlet opening into the intake air passage and a needle valve mounted on an end face of the throttle valve and projecting therefrom into the fuel nozzle, the improvement comprising an icing-preventing device including an oil nozzle connected to a source of lubricating oil and opening into the intake air passage in a position adjacent the outlet of the fuel nozzle, said oil nozzle having an annular outlet encircling said fuel nozzle.

2. An icing preventing device as claimed in claim 1 further comprising means defining an air bleed hole opening at one end into the intake air passage upstream of said oil nozzle and at the other end into said oil nozzle, and an air orifice in said air bleed hole intermediate the ends thereof.

* * * * *